US006231636B1

(12) United States Patent
Froes et al.

(10) Patent No.: US 6,231,636 B1
(45) Date of Patent: May 15, 2001

(54) MECHANOCHEMICAL PROCESSING FOR METALS AND METAL ALLOYS

(75) Inventors: Francis H. Froes; Baburaj G. Eranezhuth; Keith Prisbrey, all of Moscow, ID (US)

(73) Assignee: Idaho Research Foundation, Inc., Moscow, ID (US)

( * ) Notice: Subject to any disclaimer, the term of this patent is extended or adjusted under 35 U.S.C. 154(b) by 0 days.

(21) Appl. No.: 09/245,610

(22) Filed: Feb. 3, 1999

Related U.S. Application Data

(60) Provisional application No. 60/074,335, filed on Feb. 6, 1998.

(51) Int. Cl.[7] ..... B22F 9/04

(52) U.S. Cl. ..... 75/352; 75/354; 75/619; 75/710; 75/711; 75/745; 423/84; 423/645

(58) Field of Search ..... 75/352, 354, 617, 75/619, 620, 710, 711, 745; 423/84, 85, 645

(56) References Cited

U.S. PATENT DOCUMENTS

| | | | | |
|---|---|---|---|---|
| 2,753,255 | * | 7/1956 | Alexander et al. | 423/645 |
| 3,301,494 | * | 1/1967 | Tornquist | 75/354 |
| 3,376,107 | * | 4/1968 | Oka | 423/645 |
| 4,300,946 | * | 11/1981 | Simons | 423/645 |
| 4,902,341 | * | 2/1990 | Okudaira et al. | 75/619 |

FOREIGN PATENT DOCUMENTS

90/07012 * 6/1990 (WO) .

* cited by examiner

*Primary Examiner*—George Wyszomierski
(74) *Attorney, Agent, or Firm*—Ormiston & McKinney, PLLC

(57) ABSTRACT

A set of processes for preparing metal powders, including metal alloy powders, by ambient temperature reduction of a reducible metal compound by a reactive metal or metal hydride through mechanochemical processing. The reduction process includes milling reactants to induce and complete the reduction reaction. The preferred reducing agents include magnesium and calcium hydride powders. A process of pre-milling magnesium as a reducing agent to increase the activity of the magnesium has been established as one part of the invention.

40 Claims, 5 Drawing Sheets

XRD patterns samples of reactants ($TiuCl_4$+ 40% excess Mg) milled for (a) 10 hours and (b) 23 hours.

SEM micrograph of Mg milled with NaCl. Closely regions from the lightly deformed large Mg agglomerate show widely differing concentrations of Mg and NaCl.

TEM photomicrograph of the Ti-hydride powder showing faceted crystals in the size range of 10 to 300 nm.

Time-temperature plot during milling of $TiCl_4$ with $CaH_2$.

XRD pattern from the Ti hydride.

EDS analysis ofrom the Ti-hydride powder.
The inset SEM micrograph shows the ultrafine powder.

XRD pattern from the Ti-Al allow formed by co-reduction.

XRD pattern from the hydrided TiV produced by co-reduction.

XRD pattern from Ti-6Al-4V sample prepared by co-reduction.
The solid solution is hydrided.

MECHANOCHEMICAL PROCESSING FOR METALS AND METAL ALLOYS

CROSS REFERENCE TO RELATED APPLICATIONS

This application claims subject matter disclosed in the co-pending provisional application Ser. No. 60/074,335 filed Feb. 6, 1998, which is incorporated herein in its entirety.

This invention was funded in part by the United States Department of Energy under Subcontract No. CCS-588176 under Subcontract No. LITCO-C95-175002 under Prime Contract No. DE-AC07-941D13223. The United States government has certain rights in the invention.

FIELD OF THE INVENTION

The invention relates generally to powder metallurgy and, more particularly, to the application of mechanical alloying techniques to chemical refining through sold state reactions.

BACKGROUND OF THE INVENTION

Mechanical alloying is a powder metallurgy process consisting of repeatedly welding, fracturing and rewelding powder particles through high energy mechanical milling. Mechanochemical processing is the application of mechanical alloying techniques to chemical refining through sold state reactions. The energy of impact of the milling media, the balls in a ball mill for example, on the reactants is effectively substituted for high temperature so that solid state reactions can be carried out at room temperature. Although a number of elemental and alloy powders have been easily produced using mechanochemical processing techniques, the production of titanium has been problematic due to long milling times and the contamination associated with the long milling times.

Titanium and its alloys are attractive materials for use in aerospace and terrestrial systems. There are impediments, however, to wide spread use of titanium based materials in, for example, the cost conscious automobile industry. The titanium based materials that are commercially available now and conventional techniques for fabricating components that use these materials are very expensive. Titanium powder metallurgy, however, offers a cost effective alternative for the manufacture of titanium components if low cost titanium powder and titanium alloy powders were available. The use of titanium and its alloys will increase significantly if they can be inexpensively produced in powder form.

Currently, titanium powder and titanium alloy powders are produced by reducing titanium chloride through the Kroll or Hunter processes and hydrogenating, crushing and dehydrogenating ingot material (the HDH process). The cost of production by these processes is much higher than is desireable for most commercial uses of titanium powders. In the case of titanium alloy powders, especially multi-component alloys and intermetallics, the cost of HDH production escalates because the alloys must generally be melted and homogenized prior to HDH processing.

Presently, the production of titanium by reducing titanium chloride is a multi-step process. First titanium oxide is converted to titanium chloride in the presence of carbon at high temperature, as shown in Eq. 1.

$$TiO_2+2Cl_2 \text{ (in the presence of carbon at high temperature)} \rightarrow TiCl_4 \quad (1)$$

Then, the titanium chloride is reduced by magnesium at a temperature above 800° C. Magnesium chloride $MgCl_2$ is a by-product of the reaction in this process, which is shown in Eq. 2.

$$TiCl_4+2Mg \rightarrow Ti+2MgCl_2 \quad (2)$$

The magnesium chloride $MgCl_2$ is removed by leaching or vacuum distilling to low levels to get sponge titanium. The powder or "sponge fines" is the small size faction of the sponge. Leaching is carried out by dissolving the unreacted magnesium using a mixture of hydrochloric HCl and 10% nitric $HNO_3$ acids followed by several washings with water. The cost of producing titanium powder this way is high because of the large consumption of energy, problems associated with the high temperatures and the difficulties in removing magnesium chloride $MgCl_2$.

A number of attempts have been made in the past to reduce the cost of producing titanium sponge. These include continuous injection of titanium chloride into a molten alloy system consisting of titanium, zinc and magnesium, vapor phase reduction and aerosol reduction. Although cost reductions as high as 40% have been estimated for some of these techniques, a common feature of all of these processes is the use of high temperatures to reduce titanium chloride or titanium oxide.

Apart from cost, production of titanium base alloys present another important problem with regard to their brittleness. The use of high temperature titanium aluminides prepared by conventional techniques is limited by low ductility. Recent work on aluminides has shown that their ductility can be increased considerably by producing the material in nanocrystalline form.

SUMMARY OF THE INVENTION

The present invention is directed to a set of processes for preparing metal powders, including metal alloy powders, by ambient temperature reduction of a reducible metal compound by a reactive metal or metal hydride through mechanochemical processing. The reduction process includes milling reactants to induce and complete the reduction reaction. The preferred reducing agents include magnesium and calcium hydride powders. A process of pre-milling magnesium as a reducing agent to increase the activity of the magnesium has been established as one part of the invention.

One objective of the invention and the research efforts through which the invention was achieved is the development of a cost affordable process for the production of titanium and titanium alloy powders. The objective was approached through the reduction of titanium chloride by calcium hydride to synthesize hydrided titanium powder. Co-reduction of two or more chlorides of titanium, aluminum and vanadium has been employed to synthesize binary intermetallic compounds and the ternary work-horse alloy Ti-6Al-4V, also in hydrided powder form. Cost may be reduced by partially substituting magnesium for calcium hydride. Such substitution also reduces hydrogen pressure build- up during milling. The distinction between the use of a metallic reductant, magnesium for example, and a metal hydride, calcium hydride for example, is the production of titanium with the metal and titanium hydride with the metal hydride. In the case of hydride reducing agents, the titanium and titanium alloys formed by this process are hydrides and hence passivated against oxidation. The hydrides are readily converted to the metal by vacuum annealing.

DETAILED DESCRIPTION OF THE INVENTION

Figure 1A:
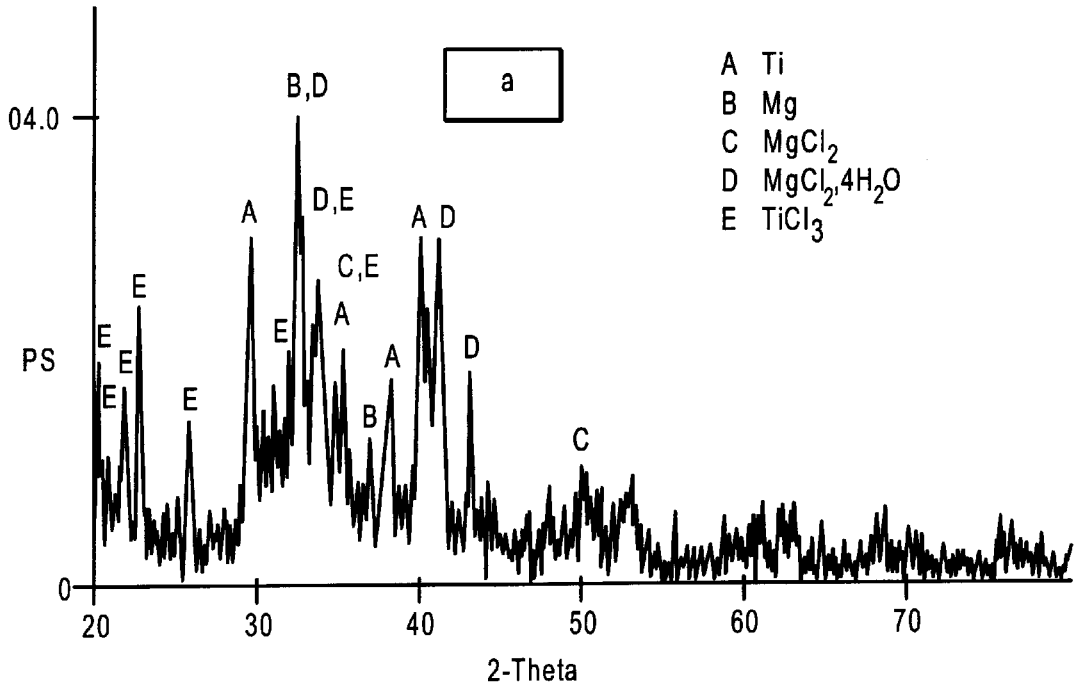
FIG. 1*a* shows the XRD patterns for samples of reactants ($TiCl_4$+40% excess Mg) milled for 10 hours.

"Milling" as used in this Specification and in the Claims means mechanical milling in a ball mill, attrition mill, shaker mill, rod mill, or any other suitable milling device. "Metal powder" as used in this Specification and in the Claims includes all forms of metal and metal based reaction products, specifically including but not limited to elemental metal powders, metal hydride powders, metal alloy powders and metal alloy hydride powders.

Fundamentals of Mechanochemical Processing Techniques

A solid state reaction, once initiated, will be sustaining if the heat of reaction is sufficiently high. It has been shown recently that the conditions required for the occurrence of reduction-diffusion and combustion synthesis reactions can be simultaneously achieved by mechanically alloying the reactants. Mechanical alloying is a powder metallurgy process consisting of repeatedly welding, fracturing and rewelding powder particles through high energy mechanical milling. Mechanochemical processing is the application of mechanical alloying techniques to chemical refining through sold state reactions. The energy of impact of the milling media, the balls in a ball mill for example, on the reactants is substituted for high temperature so that solid state reactions can be carried out at room temperature. In recent experiments, a number of nanocrystalline metal and alloy powders have been prepared through solid state reactions employing mechanical alloying.

The chemical kinetics of solid state reactions are determined by diffusion rates of reactants through the product phases. Hence, the activation energy for the reaction is the same as that for the diffusion. The reaction is controlled by the factors which influence diffusion rates. These factors include the defect structure of reactants and the local temperature. Both of these factors are influenced by the fracture and welding of powder particles during milling when unreacted materials come into contact with other material. Milling causes highly exothermic reactions to proceed by the propagation of a combustion wave through unreacted powder. This is analogous to self propagating high temperature synthesis.

Mechanochemical processing is advantageous because the reduction reactions, which are normally carried out at high temperatures, can be achieved at ambient temperatures. Fine powder reaction products can be formed by mechanochemical processing. Hence, this technique provides a viable option for the production of nanocrystalline materials. And, the absence of high temperatures minimizes the evolution of hot gaseous products and air pollution. In the present invention, mechanical forces are used to induce the reduction chemical reaction at ambient temperatures. Prior studies of the use of mechanochemical processing techniques to produce titanium Ti showed that the reactants must be milled for about 48 hours to complete the reaction between titanium chloride $TiCl_4$ and magnesium Mg. These studies were initially tested by the Applicants, as described below, as a benchmark against which improvements could be measured.

Reduction of $TiCl_4$ Through Mechanochemical Processing

Titanium chloride $TiCl_4$ is a liquid with a high vapor pressure. Titanium chloride $TiCl_4$ also easily hydrolyzes with the moisture in air. The magnesium Mg and calcium hydride $CaH_2$ used in the examples described below were 99.8% pure and had a particle size of −325 mesh. The mechanical milling induced reactions were carried out in a Spex 8000 mixer mill using hardened steel vials and 4.5 mm diameter balls. A 10:1 mass ratio of balls to reactants was employed in all examples. The vials may be made of titanium to minimize corrosion and contamination. The vials were loaded and sealed and the powder was handled inside an argon filled glove box. A thermocouple was attached to the outside flat surface of the vial with insulation between the vial and its holder frame. After starting the mill, temperature measurements were taken at two minute intervals. The temperature inside the vial increases due to two factors: (1) mechanical working and (2) solid state chemical reactions. The mechanical contribution to temperature rise can be separated from the overall time-temperature plot by milling a material which does not undergo a transformation during milling. The temperature measurements of the chemical changes have been evaluated using this procedure. The powders were characterized using X ray diffraction (XRD), scanning electron microscopy (SEM) and transmission electron microscopy (TEM).

Initially, reduction reactions were carried out by milling titanium chloride $TiCl_4$ with the "as-received" magnesium Mg powder. That is, commercially available 99.8% pure magnesium Mg powder having −325 mesh size particles was used without any processing to modify its activity. Different levels of excess magnesium Mg were used in these experiments to evaluate the effect of solid reactant concentration on the time necessary to complete the reaction. In one experiment, a combination of 7.83 grams of titanium chloride $TiCl_4$ and 2.41 grams of magnesium Mg powder were packed into the vial. This quantity of magnesium Mg was 20% in excess of stoichiometric weight. The milled powders were leached once with a 5–10% solution of formic acid and then several times with water.

Figure 1B:
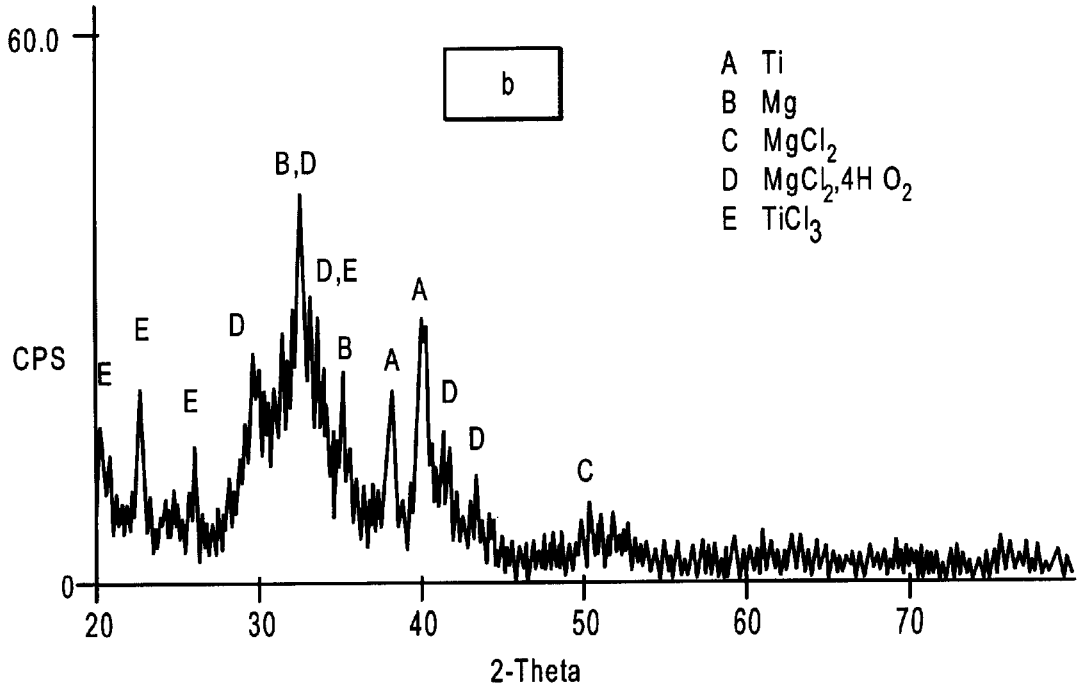
FIG. 1*b* shows the XRD patterns for samples of reactants ($TiCl_4$+40% excess Mg) milled for 23 hours.

FIGS. 1(*a*) and (*b*) are XRD patterns taken from samples of $TiCl_4$+Mg milled for 10 and 23 hours, respectively. The reduction reaction progresses with time leading to the formation of relatively large amounts of titanium Ti. Even with an excess of magnesium Mg, complete reduction is not achieved after milling for 23 hours. In the early stages, between 0 and 23 hours, the reactants formed a viscous slurry which impeded the motion of the balls. Lower chlorides of Ti have been found in the vial even after milling for times up to 40 hours. It took about 50 hours of milling to complete the reaction. Temperature measurements at two minute interval during milling showed an initial increase up to 42° C. Thereafter, the temperature remained virtually unchanged throughout the experiment. The initial increase and the subsequent stabilization of the temperature are due to the balancing of heat generation in the milling vial and heat transfer by the fan built in to the Spex mill. The absence of a temperature rise after stabilization indicates the very slow reaction between the "as-received" magnesium Mg and TiCl4.

Reduction Reactions Using Pre-Milled Mg

In one aspect of the invention, milling time is reduced by pre-milling the magnesium Mg powder to increase its surface area and reactivity. Pre-milling the magnesium Mg reduces the reaction time to about 4 hours. It is desirable to pre-mill the magnesium Mg along with sodium chloride NaCl before milling with $TiCl_4$ or other reactants. The reaction by-product, magnesium chloride $MgCl_{21}$ and the starting sodium chloride NaCl are subsequently leached out to lower levels using dilute hydrochloride acid and water. The product after leaching is titanium Ti powder having a typical particle size of 5–300 nm.

Figure 2:
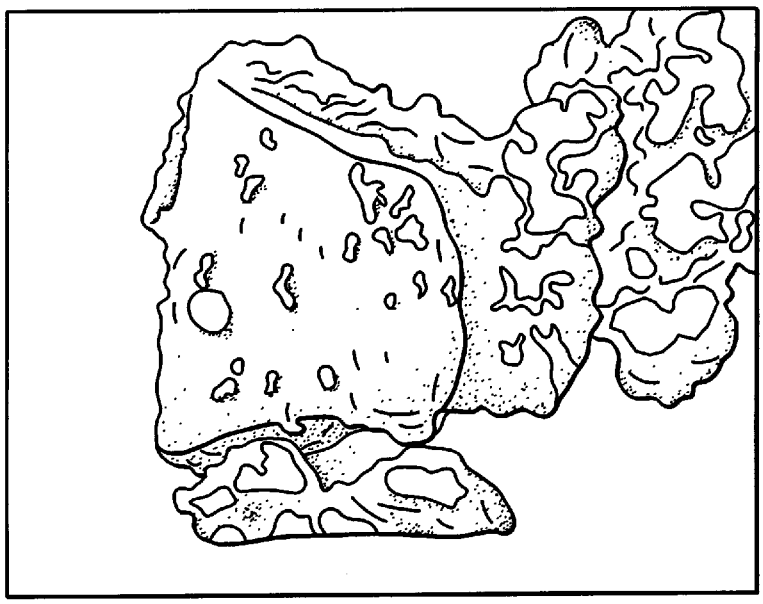
FIG. 2 is an SEM micrograph of Mg milled with NaCl.

In pre-milling experiments, 2.92 g of magnesium Mg and 1.46 g of sodium chloride NaCl along with 100 gram balls were packed in the Spex vial under argon atmosphere and milled for 1 hour. The vial was then opened in an argon atmosphere and 7.83 g of titanium chloride $TiCl_4$ were added and milled again for different times. FIG. 2 shows the effect of pre-milling of magnesium Mg with sodium chloride NaCl for 1 hour. During milling, the sodium chloride NaCl fragments into fine crystals and penetrate into the magnesium Mg. FIG. 2 shows fractured magnesium Mg particles with a distribution of fine sodium chloride NaCl particles. These fine particles could not be resolved by SEM. However, EDS analysis from different points on the same Magnesium Mg particle shows large variations in the ratio of magnesium Mg to sodium chloride NaCl. All the point to point analysis on a number of crystals confirmed the presence of magnesium Mg and sodium chloride NaCl, indicating a fine distribution of the salt in magnesium Mg. Pre-milling for one hour reduced the magnesium Mg particles from about 30 microns initially to sizes in the range of about 0.05 microns to 5 microns.

Using magnesium Mg pre-milled for 1 hour, the reduction reaction was completed in about 6 hours. This is substantially lower than the 48–50 hours it takes to complete the reaction using as-received magnesium Mg. It is expected that pre-milling for a period of time in the range of 15 minutes to 120 minutes will be effective to reduce the subsequent reduction reaction milling times to 4–6 hours.

Figure 3:
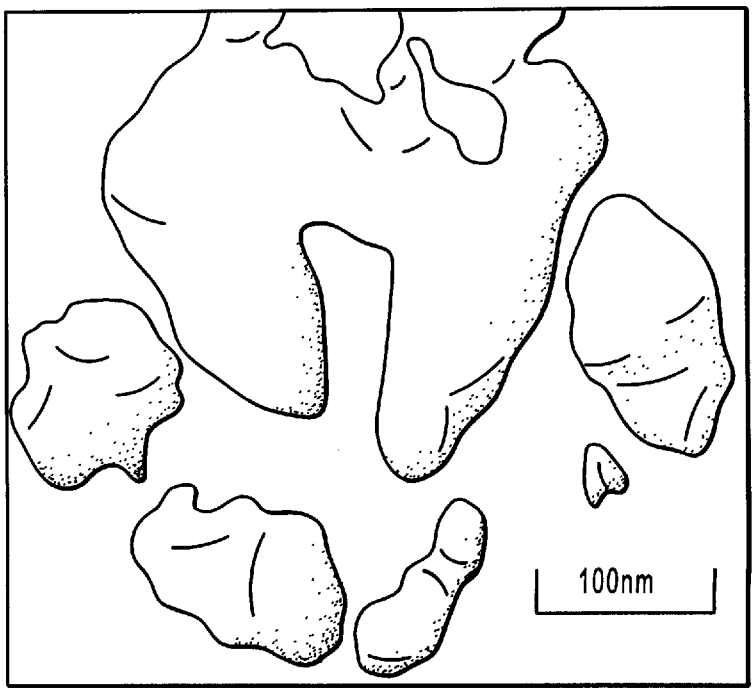
FIG. 3 is the TEM photomicrograph of the titanium hydride powder showing faceted crystal in the size range of 10 to 300 nm.

The temperature rise after about 5 hours of milling time using pre-milled magnesium Mg is about 4° C. above the stabilized temperature observed for the "as-received" magnesium Mg of 42° C. Although this temperature rise is small, the exothermic effect is discernible. By contrast, there was no temperature rise above 42° C. using the as-received magnesium Mg. FIG. 3 is the TEM photomicrograph of the titanium hydride $TiH_2$ powder after leaching with dilute hydrochloric acid HCl. During leaching, the excess magnesium Mg reacts with HCl and the hydrogen thus formed may hydride the titanium Ti present in the reaction product. The particle size of the powder can be seen to vary between about 10 to 300 nm.

The factors influencing the kinetics of a reaction during mechanical milling include: (a) enthalpy change between the reactants and products, ΔH; (b) reaction temperature; (c) area of contact between reactants; (d) diffusivity of reactants through the product; (e) defect structure of the solid reactant; and (f) the energy associated with the collisions. Enthalpy change for the reaction ($TiCl_2$+2Mg–Ti+2$MgCl_2$) is 107 kJ/mole at 298 K. For the reaction between titanium chloride $TiCl_4$ and as-received magnesium Mg, the rate of reaction is low in spite of the large reaction enthalpy. The reason for this low reaction rate can be traced to the milling process inside the vial. Under normal conditions for milling powders, balls move within the media as free projectiles. The only obstruction encountered in this process is the fine particles of the components being milled. On the other hand, a combination of the liquid titanium chloride $TiCl_4$ and solid magnesium Mg causes the formation of a viscous slurry. With the progress of milling, the balls become embedded in the viscous mass and effective movement of individual balls is restricted. This fact is shown by an examination of the vial prior to the completion of milling. The balls could be seen embedded in the reactant mass, impeding the reaction rate.

Pre-milling the magnesium Mg with sodium chloride NaCl plays an important role in reducing the mechanochemical processing time. Sodium chloride NaCl is a harder and more brittle material than magnesium Mg. Therefore, the milling process easily shatters sodium chloride NaCl into fine particles and they become embedded in the larger magnesium Mg particles to form metal/salt composite particles, as shown in FIG. 2. The use of sodium chloride NaCl improves the ease of fragmentation and reduces the agglomeration of the magnesium Mg particles.

Pre-milling appears to improve reactivity in several ways. The smaller magnesium Mg particles and corresponding greater surface area increases the reaction rate. Freshly formed surfaces on the magnesium Mg particles contribute to reactivity. Therefore, it is desireable to pre-mill the magnesium Mg immediately before the subsequent milling that induces the reduction reaction. Another important factor could be the wetting of sodium chloride NaCl within the metal/salt composite. The NaCl/Mg interface wet with titanium chloride $TiCl_4$, possibly, brings about local high concentrations of the reactants within small reaction volumes to increases the reaction rate. Under these conditions, the reduction reaction proceeds at a faster rate, in spite of the slurry formation inside the vial. The use of sodium chloride NaCl as a pre-milling agent also may enhance the leaching process due to the large solubility of sodium chloride NaCl in water.

Mechanochemical Reduction Of $TiCl_4$ By $CaH_2$

Figure 4:
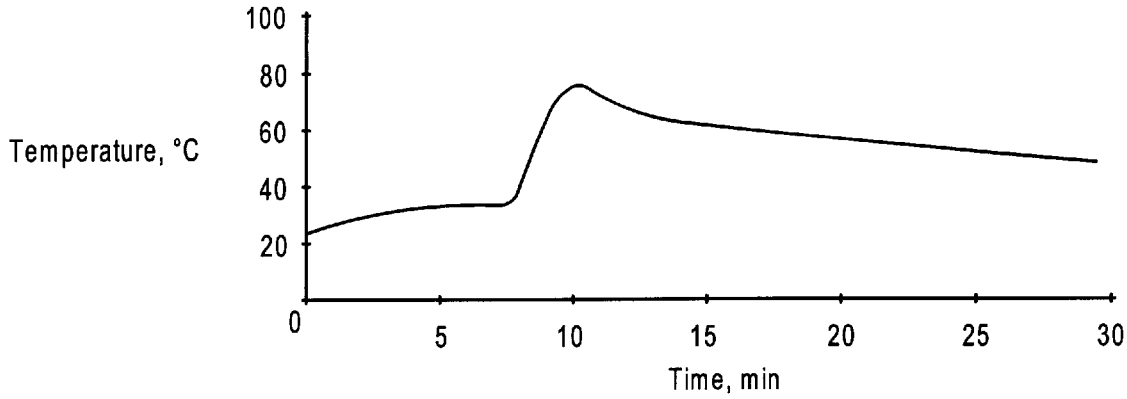
FIG. 4 shows the time vs. temperature plot for milling titanium chloride $TiCl_4$ and calcium hydride $CaH_2$.

Stoichiometric amounts of titanium chloride $TiCl_4$ and calcium hydride $CaH_2$ were used for the reduction reaction (2.56 gm of CaH2 and 3.79 gm of TiCl4)

$$TiCl_4+2CaH_2 \rightarrow TiH_2 \rightarrow 2CaCl_2+H_2 \quad (3)$$

which results in the formation of the hydride in a salt matrix. The reaction product after milling was leached with formic acid and water to remove the calcium hydride $CaCl_2$. FIG. 4 shows the time vs. temperature plot for milling titanium chloride $TiCl_4$ and calcium hydride $CaH_2$. The plot shows only the heat of reaction component of the temperature increase during milling. The mechanical component contributing to temperature rise has been subtracted out and so the time-temperature plot only shows the anomalous heat of reaction effect. The temperature initially increased slowly for ten minutes and then rapidly increased from 23° C. to 83° C. after only ten minutes of milling. Milling was stopped after 20 minutes to ensure completion of the reaction.

Figure 5:
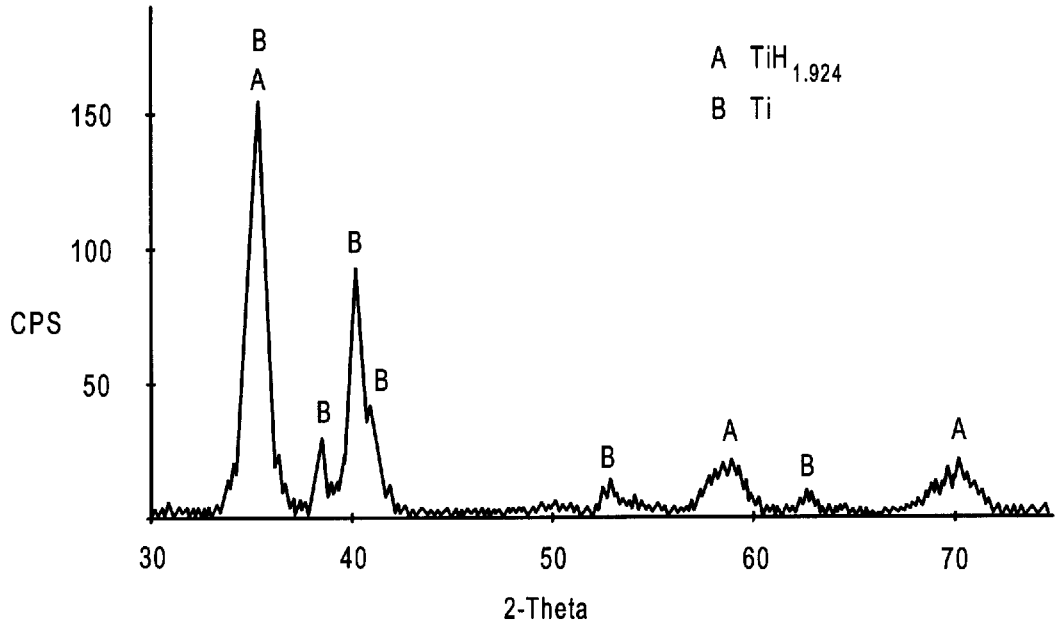
FIG. 5 shows the XRD pattern for titanium hydride $TiH_2$ powder.
Figure 6:
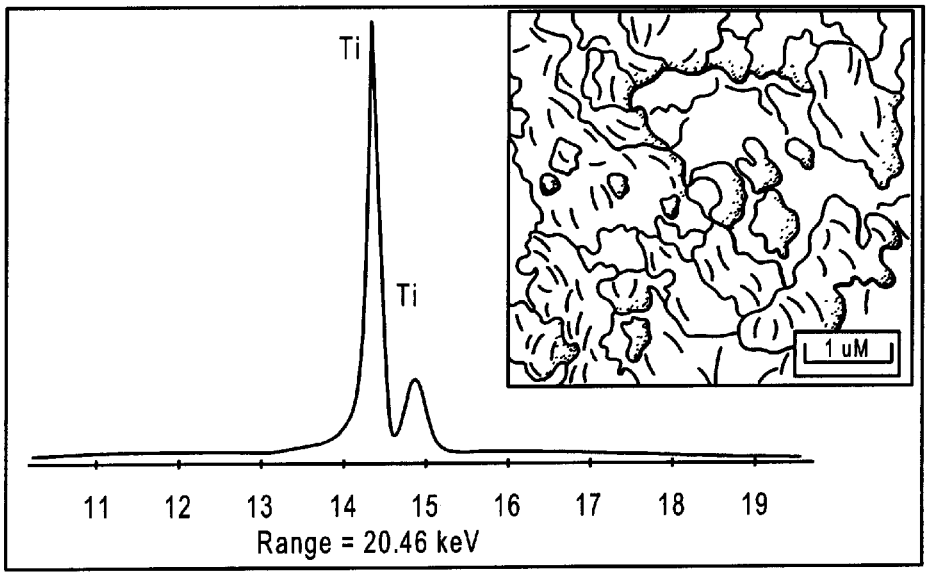
FIG. 6 is an EDS analysis from titanium hydride $TiH_2$ powder with an SEM inset showing the powder.

The XRD pattern for the titanium hydride powder is shown in FIG. 5. The characteristic EDS spectrum and the SEM micrographs of the powder after several leachings are shown in FIG. 6. The hydride particles are in the sub-micron range and show the presence of only titanium Ti. During reduction reactions using calcium hydride CaH2, the contamination from the milling vial is either absent or below the detection level of EDS analysis. FIG. 3 is a TEM photomicrograph of the titanium hydride powder showing faceted crystals in the range of 10 nm to 300 nm. The XRD pattern shows peaks corresponding to titanium hydride $TiH_{1.97}$. The large peak width observed in this pattern indicates the fine particle size of the titanium hydride $TiH_{197}$.

The enthalpy change in the reaction between titanium chloride $TiCl_4$ and calcium hydride $CaH_2$ is larger than the enthalpy change in the reaction between titanium chloride $TiCl_4$ and magnesium Mg. The enthalpy, free energy and entropy of formation of the reactants and products are given in Table 1. The sums of enthalpies for the reactants and products can be evaluated from the table. The difference between the sum of enthalpies of the products and reactants gives the value of 134 kcal/mol.

TABLE 1

Enthalpy, Free Energy and Entropy of Formation of Reactants and Products

| Substance | ΔH (kcal/mole) | ΔG (kcal/mole) | ΔS (cal/deg/mole) |
|---|---|---|---|
| $CaH_2$ | −41.6 | −32.6 | −30.4 |
| $TiH_2$ | −29.6 | −20.6 | −30.3 |
| $TiCl_4$ | −192.0 | −174.0 | −60.3 |
| $CaCl_2$ | −190.0 | 182.6 | −25.0 |

The temperature rise due to the mechanochemical process, seen in FIG. 4, is associated with the attainment of a critical reaction rate above which the reaction becomes self sustaining, thereby leading to anomalous combustion effects. This occurs due to the positive heat balance between the heat generated and dissipated within the reaction volume. The use of calcium hydride $CaH_2$ in place of magnesium Mg is advantageous in the following respects: (1) the reaction time reduces exponentially due to the large enthalpy change involved; (2) short milling time reduces contamination from the vial to negligibly small levels; and (3) the Ti hydride formed during the reaction automatically eliminates the oxidation of the fine powder product.

Co-Reduction Of $TiCl_4$ And $AlCl_3$ By $CaH_2$

Figure 7:
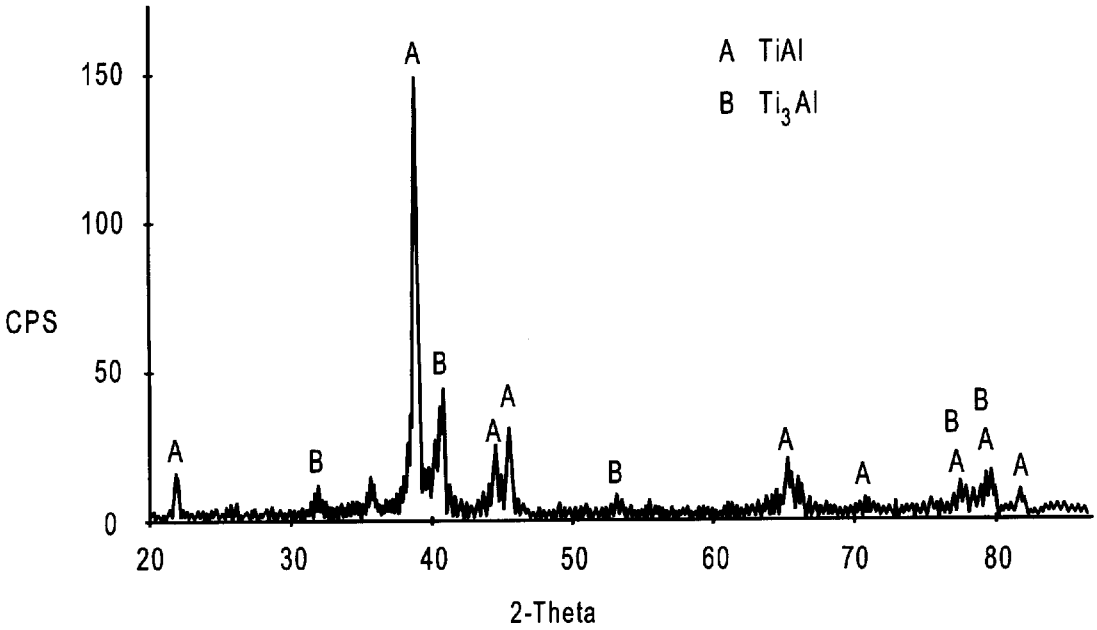
FIG. 7 shows the XRD pattern for TiAl alloy formed by co-reduction.

Titanium chloride $TlCl_4$ and aluminum chloride $AlCl_3$ in mole ratios of 1:1 were co-reduced by calcium hydride $CaH_2$. The reduction reaction $$2TiCl_4+2AlCl_3+7CaH_2 \rightarrow 2TiAlH_x+7CaCl_2+(7-x)H_2 \quad (4)$$

where $0 \leqq x \leqq 2$ was expected to produce the intermetallic TiAl after leaching and dehydriding. However, and referring to FIG. 7, the product shows a combination of TiAl and TiAl. The commencement of the reaction has been observed after twelve minutes of milling. The reaction was completed after about twenty five minutes of milling.

Co-Reduction of $TiCl_4$ and $VCl_3$ By $CaH_2$

Figure 8:
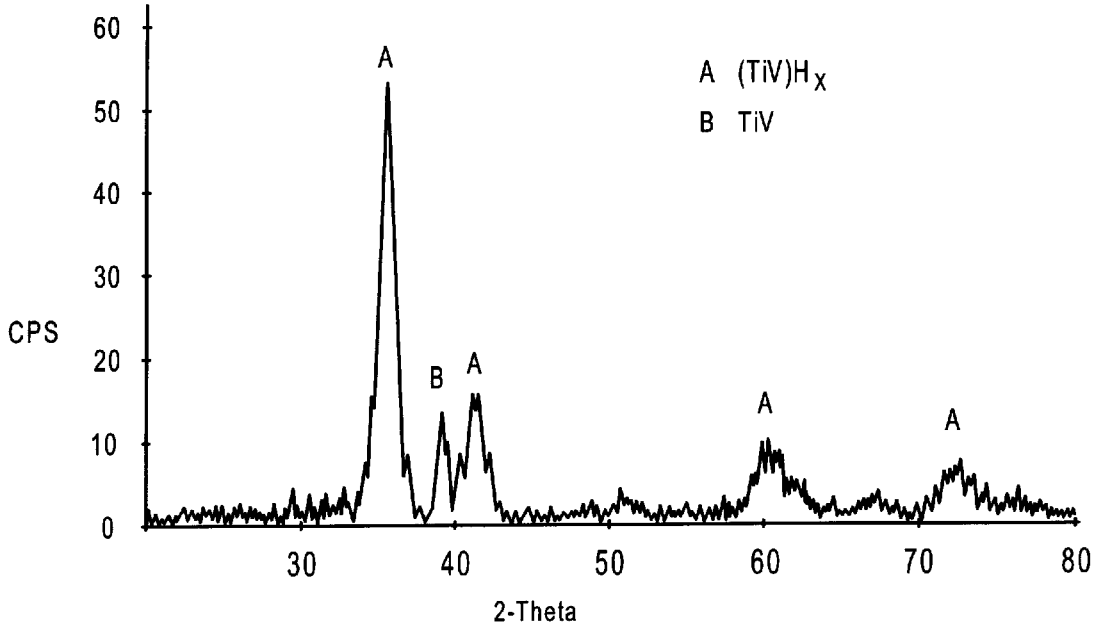
FIG. 8 shows the XRD pattern for TiVl alloy formed by co-reduction.

Titanium chloride $TiCl_4$ and vanadium chloride $VCl_3$ in mole ratios of 1:1 were co-reduced by calcium hydride $CaH_2$. The reduction reaction $$2TiCl_4+2VCl_3+7CaH_2 \rightarrow 2TiVH_x+7CaCl_2+(7-x)H_2 \quad (5)$$

where $0 \leqq x \leqq 2$ produces $Ti_{50}V_{50}$. The reaction started after forty minutes of milling and was completed after about sixty minutes of milling. The longer milling time compared to the co-reduction of titanium chloride $TlCl_4$ and aluminum chloride $AlCl_3$ is consistent with the lower formulation enthalpy for TiV compared to TiAl. FIG. 8 is the XRD pattern for the leached powder products. All of the XRD peaks in this pattern closely match titanium hydride $TiH_2$ with a consistent deviation of the peaks to the larger angle side due to the change in lattice parameter of the $TiVH_x$ solid solution compared with that of titanium hydride $TiH_2$. TiV forms a hydride similar to titanium hydride $TiH_2$.

Dehydriding of all the hydrided powders in the form of metal or alloy can be achieved by vacuum annealing.

Co-Reduction Of $TiCl_4$,$AlCl_3$ and $VCl_3$ By $CaH_2$

Figure 9:
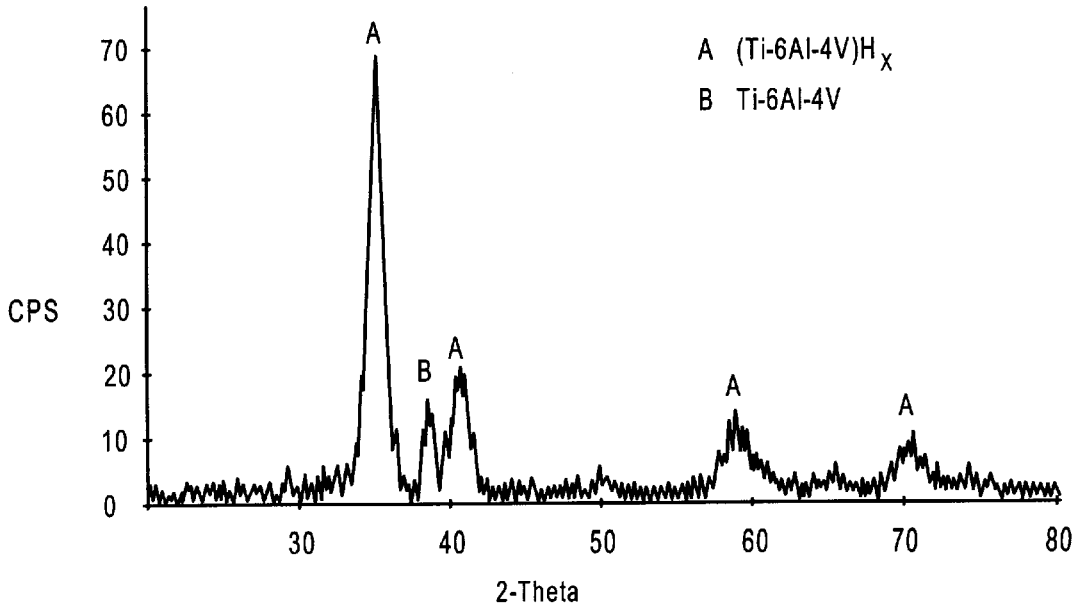
FIG. 9 shows the XRD pattern for Ti-6Al-4V alloy formed by co-reduction.

The reactants titanium chloride $TlCl_4$, aluminum chloride $AlCl_3$ and vanadium chloride $VCl_3$ taken in proportion to the composition of the alloy, Ti-6Al-4V, were co-reduced by calcium hydride $CaH_2$. The reaction product is a hydride of the Ti base solid solution. The XRD pattern of the leached powder shown in FIG. 9 matches with that of Ti hydride, with a small shift due to alloying addition. The EDS analysis of the powder shows presence of all the three elements. Therefore, the reaction product is a hydride of the alloy Ti-6Al-4V.

Partial Substitution of Mg For $CaH_2$ in the Reduction Reactions

The mechanochemical reduction of the titanium, aluminum and vanadium chlorides with calcium hydride $CaH_2$ produces hydrogen gas. The hydrogen gas pressurizes the reaction vessel. The reduction reaction can be modified to reduce the build-up of hydrogen gas and, incidentally, to reduce cost by substituting magnesium Mg for some of the calcium hydride $CaH_2$. The modified reduction reaction is shown in Eq. 6.

$$TiCl_4+Mg+CaH_2 \rightarrow TiH_2+CaCl_2+MgCl_2 \quad (6)$$

The magnesium Mg and calcium hydride $CaH_2$ reducing agents were used in a 1:1 mole ratio. The magnesium Mg and calcium hydride $CaH_2$ were pre-milled prior to addition of titanium chloride $TiCl_4$. The hydride formed during all of these reactions has the formula $TiH_{1.94}$. Even when magnesium Mg is used as shown in Eq. 6, a small amount of hydrogen gas evolves. The titanium Ti product formed with magnesium Mg and calcium hydride $CaH_2$ reducing agents has been found to be similar to that formed using only calcium hydride $CaH_2$ for all of the reactions described above for Eqs. 3–5. In all the cases the reaction time required for calcium hydride $CaH_2$ alone or in combination with magnesium Mg was practically the same.

The invention has been shown and described with reference to the production of titanium Ti and titanium Ti alloys in the foregoing embodiments. It will be understood, however, that the invention may be used in these and other embodiments to produce other metals and alloys. It is expected that the invented processes may be used effectively to produce metal powders for most or all of the metals of Groups III, IV and V of the Periodic Table, including, for example, scandium, yttrium, lanthanum and the lanthanides, cerium, praseodymium, neodymium, lutetium, actinium and the actinides, thorium, protactinium, uranium and the transuranics, titanium, zirconium, hafnium, vanadium, niobium and tantalum. Also, it is expected that magnesium hydride, for example, alone or in combination with magnesium Mg as well as other reactive metals and metal hydrides such as calcium, lithium, sodium, scandium and aluminum may be used effectively as a reducing agent. Therefore, the embodiments of the invention shown and described may be modified or varied without departing from the scope of the invention, which is set forth in the following claims.

What is claimed is:

1. A process for producing a metal powder, comprising mechanically inducing a reduction reaction between a reducible metal compound of that metal and a metal hydride.

2. The process according to claim 1, wherein mechanically inducing the reaction comprises milling the reducible metal compound and the metal hydride.

3. The process according to claim 1, wherein the metal hydride is calcium hydride $CaH_2$.

4. The process according to claim 1, wherein the metal hydride is magnesium hydride $MgH_2$.

5. The process according to claim 1, wherein the metal compound contains a metal selected from the group consisting of scandium, ytterbium, lanthanum and the lanthanides, cerium, praseodymium, neodymium, lutetium, actinium and the actinides, thorium, palladium, uranium and the transuranics, titanium, zirconium, hafnium, vanadium, niobium and tantalum.

6. A process for producing a metal powder, comprising mechanically inducing a reduction reaction between a reducible metal compound of that metal, calcium hydride $CaH_2$ and magnesium Mg.

7. The process according to claim 6, where in the metal compound contains a metal selected from the group consisting of scandium, yttrium, lanthanum and the lanthanides, cerium, praseodymium, neodymium, lutetium, actinium and the actinides, thorium, protactinium, uranium and the transuranics, titanium, zirconium, hafnium, vanadium, niobium and tantalum.

8. The process according to claim 6, wherein the mechanically inducing the reaction comprises milling the reducible metal compound, the calcium hydride $CaH_2$ and the magnesium Mg.

9. A process for producing titanium hydride $TiH_2$, comprising mechanically inducing the reduction of titanium chloride $TiCl_4$ by calcium hydride $CaH_2$.

10. The process according to claim 9, wherein the reaction is induced by milling titanium chloride $TiCl_4$ and calcium hydride $CaH_2$.

11. The process according to claim 9, further comprising dehydriding the titanium hydride $TiH_2$.

12. A process for producing a titanium powder, comprising mechanically inducing the reaction $TiC_4+2CaH_2 \rightarrow TiH_2+2CaCl_2+H_2$.

13. The process according to claim 12, wherein the reaction is induced by milling titanium chloride $TiCl_4$ and calcium hydride $CaH_2$.

14. The process according to claim 12, further comprising removing calcium chloride $CaCl_2$ from the reaction products.

15. The process according to claim 14, further comprising leaching the reaction products to remove calcium chloride $CaCl_2$.

16. The process according to claim 14, further comprising vacuum distilling the reaction products to remove calcium chloride $CaCl_2$.

17. The process according to claim 12, further comprising dehydriding the titanium hydride $TiH_2$.

18. The process according to claim 17, further comprising heating the titanium hydride $TiH_2$ to about 600° C. for about five minutes under a dynamic vacuum of about $10^{-3}$ torr.

19. A process for producing a titanium alloy $TiAlH_x$, comprising mechanically inducing the co-reduction of titanium chloride $TiCl_4$ and aluminum chloride $AlCl_3$ by calcium hydride $CaH_2$.

20. The process according to claim 18, wherein the reaction is induced by milling titanium chloride $TiCl_4$, aluminum chloride $AlCl_3$ and calcium hydride $CaH_2$.

21. The process according to claim 19, further comprising dehydriding the $TiAlH_x$.

22. A process for producing a titanium alloy powder, comprising mechanically inducing the reaction $2TiCl_4+2AlCl_3+7CaH_2 \rightarrow 2TiAlH_x+7CaCl_2+(7-x)H_2$.

23. The process according to claim 22, wherein the reaction is induced by milling titanium chloride $TiCl_4$, aluminum chloride $AlCl_3$ and calcium hydride $CaH_2$.

24. The process according to claim 23, further comprising removing calcium chloride $CaCl_2$ from the reaction products.

25. The process according to claim 24, further comprising leaching the reaction products to remove calcium chloride $CaCl_2$.

26. The process according to claim 24, further comprising vacuum distilling the reaction products to remove calcium chloride $CaCl_2$.

27. The process according to claim 22, further comprising dehydriding the $TiAlH_x$.

28. The process according to claim 27, further comprising heating the $TiAlH_x$ to about 600° C. for about five minutes under a dynamic vacuum of about $10^{-3}$ torr.

29. A process for producing a titanium alloy $TiVH_x$, comprising mechanically inducing the co-reduction of titanium chloride $TiCl_4$ and vanadium chloride $VCl_3$ by calcium hydride $CaH_2$.

30. The process according to claim 29, wherein the reaction is induced by milling titanium chloride $TiCl_4$, vanadium chloride $VCl_3$ and calcium hydride $CaH_2$.

31. The process according to claim 29, further comprising dehydriding the $TiVH_x$.

32. A process for producing a titanium alloy powder, comprising mechanically inducing the reaction $2TiCl_4+2VCl_3+7CaH_2 \rightarrow 2TiVH_x+7CaCl_2+(7-x)H_2$.

33. The process according to claim 32, wherein the reaction is induced by milling titanium chloride $TiCl_4$, vanadium chloride $VCl_3$ and calcium hydride $CaH_2$.

34. The process according to claim 32, further comprising removing calcium chloride $CaCl_2$ from the reaction products.

35. The process according to claim 34, further comprising leaching the reaction products to remove calcium chloride $CaCl_2$.

36. The process according to claim 34, further comprising vacuum distilling the reaction products to remove calcium chloride $CaCl_2$.

37. The process according to claim 32, further comprising dehydriding the $TiVH_x$.

38. The process according to claim 37, further comprising heating the $TiVH_x$ to about 600° C. for about five minutes under a dynamic vacuum of about $10^{-3}$ torr.

39. A process for producing a titanium alloy Ti-6Al-4V, comprising mechanically inducing the co-reduction of titanium chloride $TiCl_4$, aluminum chloride $AlCl_3$ and vanadium chloride $VCl_3$ by calcium hydride $CaH_2$.

40. The process according to claim 39, wherein the reaction is induced by milling titanium chloride $TiCl_4$, aluminum chloride $AlCl_3$, vanadium chloride $VCl_3$ and calcium hydride $CaH_2$.

* * * * *